United States Patent [19]

Cooper

[11] 4,377,956

[45] Mar. 29, 1983

[54] PIPE EXTRACTOR TOOL

[76] Inventor: Dennis Cooper, 4315 S. Elati, Englewood, Colo. 80110

[21] Appl. No.: 171,135

[22] Filed: Jul. 22, 1980

[51] Int. Cl.[3] ..... B25B 23/08

[52] U.S. Cl. ..... 81/444; 294/95

[58] Field of Search ..... 81/444, 445, 446, 447, 81/448, 449, 111-116; 29/270, 280; 294/95

[56] References Cited

U.S. PATENT DOCUMENTS

| | | | |
|---|---|---|---|
| 1,197,648 | 9/1916 | Meyers | 294/95 |
| 1,592,987 | 7/1926 | Mayer . | |
| 1,676,775 | 7/1928 | Doherty . | |
| 1,958,330 | 5/1934 | Beard | 294/95 |
| 3,479,722 | 11/1969 | Maness | 29/280 |
| 3,654,686 | 4/1972 | McFarland et al. | 29/280 |

FOREIGN PATENT DOCUMENTS

| | | | |
|---|---|---|---|
| 441233 | 2/1927 | Fed. Rep. of Germany | 81/444 |
| 32429 | 6/1921 | Norway | 81/116 |

*Primary Examiner*—James L. Jones, Jr.
*Attorney, Agent, or Firm*—John E. Reilly

[57] ABSTRACT

A pipe extractor tool has been devised for use in removal of broken pipe sections, such as, the riser in a sprinkler system and includes cams formed at the lower end of a hollow shank through which a push rod is inserted, the cams being movable under the urging of the push rod in a generally radially outward direction into firm gripping engagement with the inner wall of the pipe section to be removed so that a twist or torque can be applied to the tool to unthread and remove the broken pipe section.

4 Claims, 5 Drawing Figures

PIPE EXTRACTOR TOOL

FIELD OF INVENTION

This invention relates to novel and improved extractor tools and more particularly relates to a hand-operable extractor tool which is particularly adaptable for use in removing broken pipe sections which require unthreading from another section.

BACKGROUND OF THE INVENTION

Broken pipe sections in remote or inaccessible locations present a particular problem where it is necessary to unthread the section from another section, particularly where the pipe section has become frozen. Various tools have been devised for insertion internally of a hollow element, such as, a pipe, to grasp and lift that element from an otherwise inaccessible location. For instance, U.S. Pat. to McFarland et al No. 3,654,686 discloses a clamping tool having a spring-actuated handle portion which, when depressed, will cause a jaw or gripping member to grasp and loosen objects. The tool is specifically intended for use in lifting valve tappets internally through a motor. U.S. Pat. No. 1,676,775 to Doherty relates to a plumbers tool having a pair of arms which are forced outwardly by depression of a handle member to hold a pipe in a stationary position from the inside or to remove the pipe from another element but is not capable of removal by application of torque to standard pipes. In addition, U.S. Pat. No. 3,479,722 to Maness discloses a valve lifter tool in which a pair of lifter-engaging jaw portions are forced outwardly when a plunger is depressed to grip and remove the valve lifter from its bore without removal of the cylinder head from the engine block.

However, there are many cases where it is necessary to permit extension of a tool into the interior of a broken pipe section and which is capable of firmly gripping the inner wall of the pipe section for the application of torque to the broken pipe section in order to unthread it for removal from another section. A particular application of the present invention is to the removal of broken riser sections in a sprinkler system where the riser is broken off in the ground and is not readily accessible without digging up the turf surrounding the riser section. Further, extractors presently in use for removal of risers require two hands in order to hold the tool and a separate wrench to turn the tool.

It is therefore an object of the present invention to provide for a novel and improved tool which is conformable for use in the removal of various types and sizes of pipes or fittings and is particularly conformable for use in the removal of otherwise inaccessible underground fittings.

Another object of the present invention is to provide for a pipe extractor tool capable of removing a pipe section by the application of torque thereto and which tool is manipulable with one hand.

A further object of the present invention is to provide for a novel and improved pipe extractor tool which is comprised of a minimum number of parts and can be made in various sizes to conform to the size of the pipe section or other fitting to be removed.

SUMMARY OF THE INVENTION

In accordance with the present invention, a preferred form of extractor tool has been devised and which is particularly useful in the field of sprinkler system repairs and where it is necessary to remove broken pipe sections or fittings which are threadedly connected to other parts of the system. In the accomplishment of the foregoing, the preferred form of extractor tool includes a plurality of cams which are formed at the lower end of a hollow shank through which a push rod is inserted. The cams are pivotally mounted at the lower end of the shank for movement from an inward position within the peripheral outline of the shank to a radially outwardly directed position under the urging of the push rod into firm engagement with the inner wall of the pipe section to be removed. The cams are characterized by having outer gripping edges or teeth which are capable of effecting positive gripping engagement with the inner wall of the pipe and which are so mounted as to be capable of imparting a substantial degree of torque to the pipe section for its unthreading and removal from another section. The push rod is slidable through the hollow interior of the shank and has a leading, tapered end engageable with the inner surfaces of the cams to force the cams outwardly into gripping engagement. Most desirably, the rod is mounted within the shank under some degree of spring-loading so that it will be urged in a direction away from the cams so as to permit the cams to normally lie within the peripheral outline of the shank. The push rod can be provided with a suitable handle to facilitate its insertion through the shank; and similarly the shank can be provided with a handle at its upper end to facilitate grasping for the application of torque to the pipe section to be removed.

Other objects, advantages and features of the present invention will become more readily appreciated and understood from a consideration of the following detailed description of a preferred form of the present invention when taken together with the accompanying drawings, in which:

DETAILED DESCRIPTION OF THE PREFERRED EMBODIMENT

Figure 1:
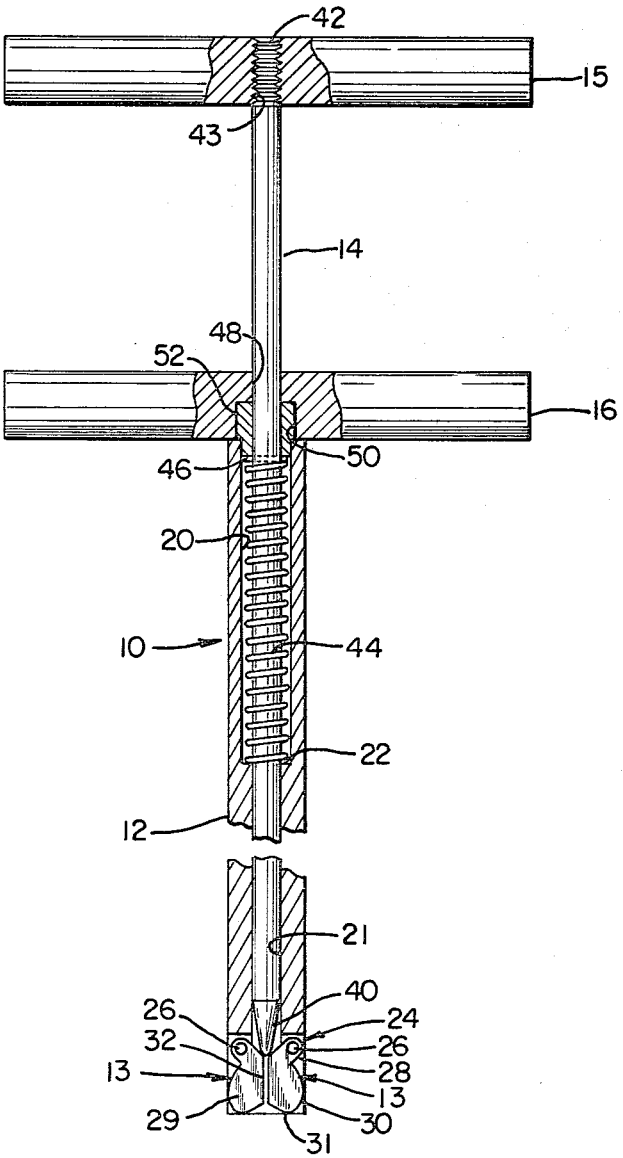
FIG. 1 is a view partially in section of the preferred form of extractor tool with the cam members of the tool shown in a retracted position.

Referring in detail to the drawings, there is illustrated a preferred form of the present invention in FIGS. 1 to 5 in which a pipe extractor tool 10 is broadly comprised of an elongated hollow body or shank 12, cam members 13 at the lower or distal end of the body 12, a push rod 14 insertable through the hollow interior of the body 12 which is provided with an upper handle 15, and a handle 16 positioned at the upper end of the body 12 is adapted to facilitate the application of a twist or torque to the body. As best seen from FIG. 2, and as a setting for the present invention, the tool will be described specifically with reference to unthreading and removal of a broken pipe or riser portion R which is threaded into the base B of a sprinkler head which is embedded below ground level. In applications such as the removal of a broken pipe or riser, the tool can be inserted into the interior part of the broken section and expanded into gripping engagement therewith whereupon application of torque to the handle 16 will effect rotation and unthreading of the broken section R for its removal from the base B without necessitating the removal of the turf surrounding the riser or sprinkler head. Of course it is to be understood that its description in connection with the removal of a broken pipe section in a sprinkler system is given by way of illustration and not limitation and the invention is readily conformable for use in other applications where it is necessary to engage a pipe or other section in a remote or inaccessible location for lifting or removal of same; or can be readily used in the installation of pipe sections especially where it is desirable to thread sections together without marring the external surfaces.

Figure 5:
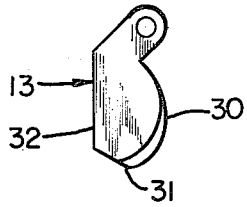
FIG. 5 is a view in detail of a preferred form of cam member of the type illustrated in FIGS. 1 and 2.

Considering in more detail the construction and arrangement of the preferred form of invention, the elongated body or shank 12 has an upper counterbore 20 which is axially aligned with a central bore 21 of reduced diameter with respect to the counterbore 20 and interconnected by a shoulder 22. The main bore 21 communicates with a lower or distal, slotted end 24 which in the preferred form comprises a series of four radially directed slots 25 at equally spaced circumferential intervals, the slots 25 being vertically directed and being open slots; i.e., open through the lower extremity of the body. A cam member 13 is housed within each slot 25 by a pivot pin 26 extending transversely through the upper end of each slot at a point which is located substantially intermediately between the longitudinal axis of the body and the external wall surface. Specifically, each cam member is preferably in the form of legs 28 and 29 disposed at an obtuse angle with respect to one another. The upper, angularly extending leg 28 terminates in an upper free end provided with an opening for insertion of the pivot pin 26. In turn, the enlarged, vertically directed leg 29 is provided with a generally convex bearing surface 30 normally aligned beneath each respective pivot pin 26, a lower extremity 31 which is reverse curved in an upward and radial inward direction from the lower edge of the bearing surface 30 and an inner, axially extending edge 32. The cams are so dimensioned as to be of a width between the edges 32 and 30 as to occupy the spaces formed within one of the slots 24 and when in a retracted position as illustrated in FIG. 1 each edge 32 will be in closely spaced parallel relation to one another. However, when the push rod 14 is extended through the central bore 21 against the upper edges of the inclined legs 28 the cams will be forced to pivot in a radial outward direction about their pivot pins 26 into the expanded position illustrated in FIG. 2 with the external bearing surfaces 30 engaging and preferably cutting into the inner wall surface of the pipe as illustrated. By virtue of the generally doglegged configuration of the cams with the upper legs 28 inclining in a radial inward direction into the lower camming portions or legs 29, the cams are capable of undergoing a substantial degree of expansion so as to compensate for any differences in size of pipe over a reasonable latitude or range of sizes. Moreover, the external bearing surfaces 30 are somewhat pointed or tapered into a knife edge as illustrated in FIG. 5 so as to increase their effectiveness and ability to bite into the inner wall surface of the pipe. In thickness, the cam members 13 are of a thickness just slightly less than the width of each respective slot 24 so that they are free to move through the slots into the expanded position described.

The push rod 14 is of elongated, solid cylindrical configuration except at its lower terminal end 40 which is tapered as illustrated into a pointed extremity, the outer diameter of the rod corresponding substantially to the diameter of the main bore 21. An upper threaded end 42 on the rod is adapted for threaded connection of the handle 15 as shown, the handle being preferably in the form of a cylindrical member having a transverse threaded counterbore 43 therein for threaded insertion of the end 42. In order to retain the push rod in assembled relation to the body 12, a coiled spring element 44 is inserted into the enlarged counterbore 20 so that the shoulder 22 serves as a stop for the leading end of the spring 44, and a pin 46 is inserted transversely through the upper midsection of the rod 14 to serve as a stop at the upper end of the spring 44. The handle 16 is similarly of elongated cylindrical configuration so as to correspond very much to that of the handle 15 and has a centrally located transverse bore 48 which corresponds to the diameter of the main bore 21 and is adapted to receive the upper end of the rod 14. The bore 48 is also formed with an enlarged counterbore 50 adapted to receive a bushing or sleeve 52 which sleeve projects downwardly from the handle 16 for close-fitting insertion into the counterbore 20 of the body and into abutting relation to the pin 46. The handle is permanently affixed to the end of the body, such as, by welding the elements together at the joint formed between the handle 16 and upper edge or other suitable fastening means may be employed therebetween.

Figure 2:
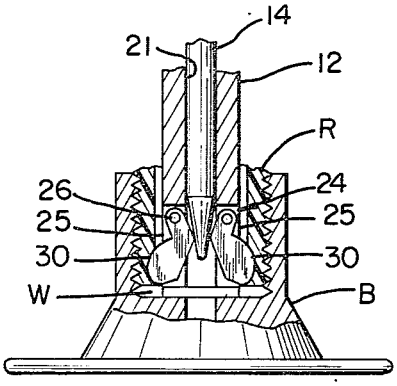
FIG. 2 is a fragmentary view of the distal or lower end of the tool with the cam member shown in an outwardly projecting position.
Figure 3:
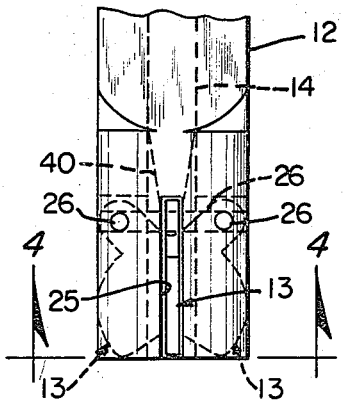
FIG. 3 is a fragmentary view, enlarged, of a modified form of cam arrangement.
Figure 4:
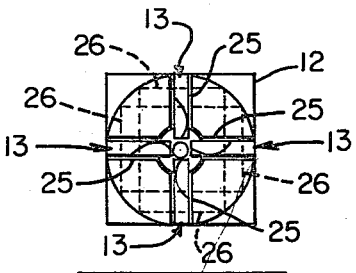
FIG. 4 is a cross-sectional view taken about lines 4—4 of FIG. 1.

In assembled relation, it will be noted that the return spring 44 will normally urge the handle 15 to the extended position as shown in FIG. 1 with the lower tapered end 40 resting directly above the camming members 13. By grasping either handle 15 or 16 the extractor tool can be inserted into the broken pipe section as illustrated in FIG. 2 until the lower slotted end of the body 12 rests upon the inner transverse wall designated at W of the base B. The handle 15 is then forced downwardly against the urging of the spring 44 to cause the tapered end 40 to bear against the cams 13 and to urge them outwardly into positive engagement with the inner wall of the pipe section or riser R; and while maintaining downward pressure on the push rod 14 the tool is rotated by hand to cause the pipe section to be rotated and unthreaded from the base proper. By maintaining continuous pressure on the push rod, once the pipe section is unthreaded it may be lifted directly out of the hole and the new pipe section inserted either by hand or by use of the extractor tool. In this relation, a notable advantage of the arrangement of the camming members within the lower slotted end of the tool is that the camming members can be positioned at or directly adjacent to the lowermost point of threaded connection of the broken pipe section R to the base. Thus, if the pipe section has been broken off at a point leaving very little left in the base for engagement by the camming members, it is nevertheless possible to effect the desired engagement with the broken section for removal.

It will be readily appreciated that the extractor tool of the present invention is conformable for use in various applications either in the removal of broken pipe sections or installation of new sections in difficult to reach or embedded areas as described. Moreover, various different bearing surfaces may be employed on the external edges 30 of the cam members 13, such as, roughened, striated or toothed edges. In the form shown, the teeth have been ground to an edge that will dig into the inner wall of the pipe with the external convex edge of the cam being cocked outwardly by the push rod. Of course, the greater the size of the pipe section with respect to the size or diameter of the tool or shank, the greater extent that the push rod can be moved downwardly through the center of the tool body expanding the cams outwardly. In this way, the force applied by the push rod against the bearing surfaces of the cam removes the application of any force or stress on the pivot points themselves. The pivot pins are mounted so that in the event of breaking of any one of the cams, the cams may be individually replaced. However, the tool is so designed that if in certain cases it were necessary to establish a most positive gripping engagement between the cam members and tool, a hammer can be used to tap the push rod downwardly to set the bearing surfaces into the wall of the pipe so that when twisted the teeth will positively grip the inner wall surface to loosen the pipe section. Preferably the elements comprising the push rod, shank and cams as well as the pivot pins are made of a high strength steel so as to be capable of withstanding the force of twisting.

It is therefore to be understood that various modifications and changes may be made in the construction and arrangement of parts comprising the present invention as well as their intended application without departing from the spirit and scope of the present invention as defined by the appended claims.

I claim:

1. A pipe extracting tool adapted for unthreading and removal of pipe sections in inaccessible locations, said tool comprising:

an elongated tubular shank adapted to be inserted into said pipe sections to be extracted having a hollow interior throughout with axially directed slots at equally spaced circumferential intervals above the lower end of said shank and a handle member at the opposite end of said shank;

generally lobe-shaped cam members each having an upper side and a lower side disposed at an angel to one another, each said lower side defining external rounded gripping edge adjacent to the lower end thereof, each of said cam members disposed within said axially directed slots in said shank, each said upper side provided with a pivot pin extending transversely of the length of each associated slot and insertable in a transverse bore formed in the wall of said shank adjacent to the upper end of each associated slot for radial movement of each cam member from an inward position normally disposed within the peripheral outline of said shank and a radially outwardly directed position engageable with the inner wall of the pipe section to be extracted;

an elongated push rod dimensioned to be of a length greater than that of said shank and adapted for insertion through the hollow interior of said shank including a leading tapered end and manually actuable means at the opposite end operative to advance said push rod into engagement with said cam members to force said cam members through said slots and radially outwardly from said slots into engagement with the inner wall of said pipe section; and bias means disposed in surrounding relation to said push rod within the hollow interior of said shank operative to normally urge said push rod in a direction away from said cam members.

2. A device according to claim 1, said bias means being in the form of a compression spring in surrounding relation to said push rod within the hollow interior of said body, and stop members in said body in axially spaced relation to one another to limit movement of said spring therein.

3. In a tool according to claim 1, each of said cam members provided with upper inclined surfaces which when disposed in the radially inward position are simultaneously engageable by the leading end of said push rod.

4. In a tool according to claim 3, each of said cam members provided with an inner radial surface forming a continuation of said upper inclined surfaces and disposable parallel to the longitudinal axis of said shank when disposed in the inward radial position.

* * * * *